US009370206B1

(12) United States Patent
Ellington

(10) Patent No.: US 9,370,206 B1
(45) Date of Patent: Jun. 21, 2016

(54) MEDICAL DEVICE PROTECTION AND COMFORT BRASSIERE

(71) Applicant: Gregory Martez Ellington, Kernersville, NC (US)

(72) Inventor: Gregory Martez Ellington, Kernersville, NC (US)

( * ) Notice: Subject to any disclaimer, the term of this patent is extended or adjusted under 35 U.S.C. 154(b) by 151 days.

(21) Appl. No.: 14/467,606

(22) Filed: Aug. 25, 2014

Related U.S. Application Data

(63) Continuation-in-part of application No. 14/245,242, filed on Apr. 4, 2014.

(60) Provisional application No. 61/853,376, filed on Apr. 4, 2013.

(51) Int. Cl.
*A41C 3/00* (2006.01)
*A41C 3/14* (2006.01)

(52) U.S. Cl.
CPC ..... *A41C 3/0064* (2013.01); *A41C 3/144* (2013.01)

(58) Field of Classification Search
CPC ..... A41C 3/00; A41C 3/02; A41C 3/0064; A41C 3/0144
USPC ..... 450/54–57, 39, 1; 2/267, 268, 244, 69, 2/67
See application file for complete search history.

(56) References Cited

U.S. PATENT DOCUMENTS

| | | | | |
|---|---|---|---|---|
| 6,786,798 | B1 * | 9/2004 | Gendel | A41C 3/02 450/1 |
| 8,084,051 | B1 | 12/2011 | Dillon | 424/402 |
| 2007/0239212 | A1 * | 10/2007 | Schneider | A43B 1/0045 607/2 |
| 2012/0158074 | A1 * | 6/2012 | Hall | A61B 5/024 607/5 |
| 2012/0304357 | A1 | 12/2012 | Highfield | 2/69 |
| 2013/0053674 | A1 * | 2/2013 | Volker | A61B 5/04085 600/389 |
| 2013/0066288 | A1 * | 3/2013 | Lin | A61F 13/51113 604/360 |
| 2013/0191959 | A1 | 8/2013 | Quiroga et al. | 2/114 |

* cited by examiner

*Primary Examiner* — Gloria Hale
(74) *Attorney, Agent, or Firm* — MacCord Mason PLLC

(57) ABSTRACT

Medical brassieres are shown and described. In one embodiment, the medical brassiere includes a first helical region and a second helical region, an adjuster, and a pair of opposing impact absorbent pads having an embedded silver infused antimicrobial and an arched lower end. Each of the helical regions include a reinforcing seam that is generally positioned along peripheral portions of the first helical region and second helical region. The medical brassiere is generally donned by a patient with an implanted medical device to provide comfort and protection against the device. In some examples, the brassiere includes a stretchable periphery assembly to provide freedom of movement, while providing uniform compression over a surgical site. The result is devices and methods to protect and comfort implanted devices, while providing an aesthetically-pleasing appearance.

18 Claims, 2 Drawing Sheets

MEDICAL DEVICE PROTECTION AND COMFORT BRASSIERE

This application is a Continuation-in-Part application of U.S. application Ser. No. 14/245,242, filed Apr. 4, 2014, which claims the benefit of U.S. provisional application No. 61/853,376, filed Apr. 4, 2013, both of which are incorporated herein by reference in their entireties.

FIELD OF THE TECHNOLOGY

The present disclosure relates generally to medical brassieres, and more particularly to an improved brassiere for protection and comfort from implanted medical devices.

BACKGROUND

Medical devices vary greatly in complexity and application to diagnose, prevent, and treat various conditions and illnesses. For instance, medical implants are devices and/or systems to enhance an existing biological structure, replace a biological structure, and/or support a damaged biological structure.

One common medical implant is an artificial pacemaker that delivers electrical impulses through electrodes to heart muscles to regulate the beating of a patient's heart. Typically, the artificial pacemaker is inserted in the left shoulder area, where an incision is made below the collar bone to create a small pocket where the pacemaker is housed. Often, post-surgical patients with an artificial pacemaker, or the like, find they must adjust their normal activities and/or suffer through painful everyday actions. For instance, surgical patients with an artificial pacemaker, or the like, must carefully minimize external contact against the implant, including routine contact against clothing, seatbelts, or similar routine contact. Further, patients having artificial implants are often self-conscious about the protrusion from their body caused by the medical device and find the contour of their clothed body aesthetically unappealing.

Various therapeutic devices have been developed to address certain needs of post-surgical patients, however these conventional devices and methods fail to provide sufficient and aesthetically-pleasing protection. Therefore, Applicant desires devices, systems, and methods for protection and comfort from implanted medical devices, particularly for female patients, without the drawbacks presented by the traditional systems and methods.

SUMMARY

In accordance with the present disclosure, devices, systems, and methods are provided for comfort and protection from medical devices and the like. This disclosure provides improved garments that are convenient and effective, particularly when donned by a female patient with an implanted medical device.

In one embodiment, a medical brassiere includes a first helical region and a second helical region, a first and a second superior spacer having impact absorbent pads, a right and left lateral spacer having impact absorbent pads, and a shoulder support and lower stretch band. Generally, the medical brassiere to be donned by a female patient with an implanted medical device. The first helical region and second helical region are joined at a front and a rear of the brassiere. Each of the helical regions typically include a reinforcing seam positioned along peripheral portions of the helical regions to define a pair of opposing cups. The first and a second superior spacers are typically aligned above the cups and the pair of opposing impact absorbent pads have an embedded silver infused antimicrobial and a concave lower end. Each impact absorbent pad is generally spaced apart from a stretchable distal periphery and aligned with an upper end of the first helical region and second helical region. The right lateral spacer is positioned laterally adjacent the first helical region and houses the impact absorbent pad. Similarly, the left lateral spacer is positioned laterally adjacent to the second helical region and houses the impact absorbent pad. In some examples, the lateral spacers are positioned proximate to an area adjacent to a subcutaneous implant. For instance, the implant may be positioned outside of the patient's ribcage, and the lateral spacers protect, and may compress, the subcutaneous implant. The shoulder support and lower stretch band generating elongate, i.e. stretch in an elongated layout, each of the helical regions and first and second spacers against a wearer when the brassiere is in an donned position, for instance regardless of a movement of the spacer about the implanted device.

In some examples, the brassiere includes a right lateral spacer positioned laterally adjacent to the first helical region, and a left lateral spacer positioned laterally adjacent to the second helical region. The impact absorbent pads may comprise a substantially concave contour, for instance to mate with the helical regions to define an integral appearance in the donned position. Any of pads may be integrated into a compression fabric. The compression fabric may comprise about eighty percent nylon and about twenty percent Lycra.

In another embodiment, a medical brassiere includes a body portion, a pair of opposing impact absorbent pads, and a stretchable distal periphery positioned between the helical regions and one of the pads. Typically, the medical brassiere is donned by a patient with an implanted medical device. In particular examples, the compression body is about eighty one percent nylon and about twenty percent lycra and receives an upper portion of a patient's torso. The body portion may include a first helical region and a second helical region joined at a rear of the brassiere and releasably joined at a front of the brassiere.

The body portion generally covers a portion of a patient's torso, wherein the body portion includes a first helical region and a second helical region joined at a front and a rear of the brassiere. The pair of opposing impact absorbent pads have an embedded silver infused antimicrobial and an arched lower end. Each impact absorbent pad is generally spaced apart from one another to allow each of the helical regions to align to a contour of a patient's chest. The stretchable distal periphery positioned may be position between the helical regions and one of the pads. A stretchable proximate periphery is typically positioned between the helical regions and at least one of the pads, and wherein the distal periphery and the proximate periphery is stretchable about two axes.

In some examples, the first helical region and the second helical region are releasably joined at least one portion of the brassiere, for instance at a front and/or rear of the brassiere. The impact absorbent pads may include a substantially convex contour to provide an appearance of symmetry to an asymmetrical breast surface. The brassiere may apply a uniform therapeutic compression between the pads and the patient's breast in the donned position. The brassiere may mask the implanted pacemaker in a donned position.

In particular examples, the pads may be integrated into a fabric of the helical region body portion. The first pad may be positioned proximate to an area that is generally adjacent to the implanted pacemaker. The first pad may reduce the incidence of the implanted pacemaker eroding from the patient's body. The first pad may reduce the movement of the implanted pacemaker about the patient's body. In addition, the first pad may reduce a friction between the implanted pacemaker and body tissue. Further, first pad may reduce an incidence of pocket revision associated with the implanted pacemaker pocket erosions.

In another embodiment, a medical brassiere to be donned by a patient with an implanted pacemaker includes a first helical region and a second helical region, an adjuster, and a pair of opposing impact absorbent pads having an embedded silver infused antimicrobial and an arched lower end. Each of the first and the second helical regions include a reinforcing seam that is generally positioned along peripheral portions of the first helical region and second helical region. The adjuster generally holds each of the helical regions against a wearer when the brassiere is in an adjusted position, for instance regardless of a movement of the helical region about the implanted pacemaker. Each impact absorbent pad is typically spaced apart from one another and aligned within each of the first helical region and second helical region. The first the pad is typically aligned over the implanted pacemaker in a donned position, while the second the pad is typically spaced parallel with the first pad to provide an appearance of symmetry to the patient's asymmetrical chest surface.

In some examples, the first helical region and the second helical region are releasably joined at least one portion of the brassiere, for instance at a front and/or rear of the brassiere. The impact absorbent pads may include a substantially convex contour to provide an appearance of symmetry to an asymmetrical breast surface. The brassiere may apply a uniform therapeutic compression between the pads and the patient's breast in the donned position. The brassiere may mask the implanted pacemaker in a donned position.

In particular examples, the pads may be integrated into a fabric of the helical region body portion. The first pad may be positioned proximate to an area that is generally adjacent to the implanted pacemaker. The first pad may reduce the incidence of the implanted pacemaker eroding from the patient's body. The first pad may reduce the movement of the implanted pacemaker about the patient's body. In addition, the first pad may reduce a friction between the implanted pacemaker and body tissue. Further, first pad may reduce an incidence of pocket revision associated with the implanted pacemaker pocket erosions.

In yet another embodiment, a medical brassiere includes a body portion adapted for receiving a portion of a patient's torso, including, but not limited to, a female patient's breasts, and has a pair of opposing impact absorbent pads, and a stretchable distal periphery. The body portion includes a first helical region and a second helical region joined at a front and a rear of the brassiere. The impact absorbent pads have an embedded silver that is generally infused antimicrobial and an arched lower end. Each impact absorbent pad is spaced apart from one another to allow each of the helical regions to align to a contour of a patient's chest. The stretchable distal periphery is generally positioned between the helical regions and one of the pads. The distal periphery and the proximate periphery are stretchable about two axes.

In particular examples, a first the pad being is generally aligned over the implanted medical device in a donned position, while a second pad is parallel to the first pad to provide an appearance of symmetry to a patient's asymmetrical breast surface.

In some examples, the first helical region and the second helical' region are releasably joined at least one portion of the brassiere, for instance at a front and/or rear of the brassiere. The impact absorbent pads may include a substantially convex contour to provide an appearance of symmetry to an asymmetrical breast surface. The brassiere may apply a uniform therapeutic compression between the pads and the patient's breast in the donned position. The brassiere may mask the implanted pacemaker in a donned position.

In certain examples, the pads may be integrated into a fabric of the helical region body portion. The first pad may be positioned proximate to an area that is generally adjacent to the implanted pacemaker. The first pad may reduce the incidence of the implanted pacemaker eroding from the patient's body. The first pad may reduce the movement of the implanted pacemaker about the patient's body. In addition, the first pad may reduce a friction between the implanted pacemaker and body tissue. Further, first pad may reduce an incidence of pocket revision associated with the implanted pacemaker pocket erosions.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
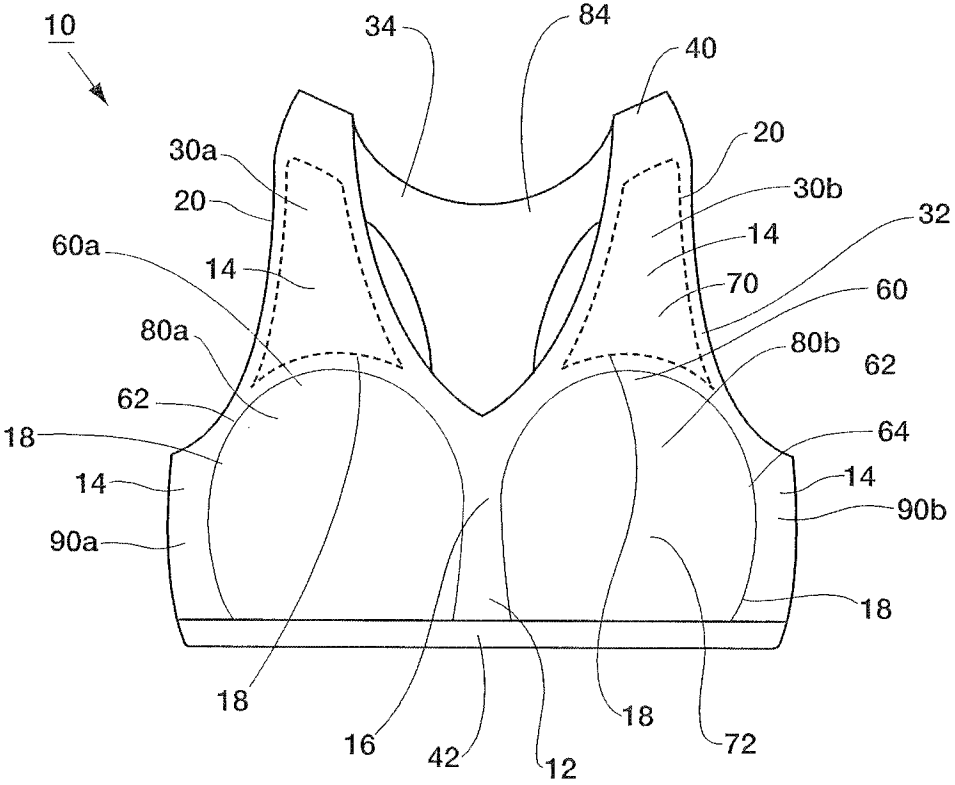
FIG. 1 is a front perspective view of a medical protection and comfort brassiere according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
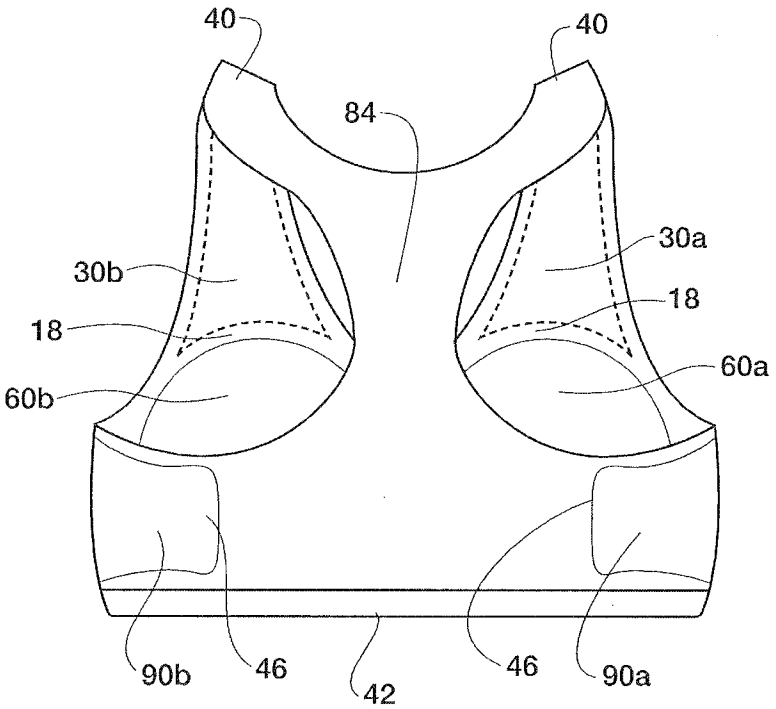
FIG. 2 is a rear perspective view of the medical protection and comfort brassiere introduced in FIG. 1.

Referring now to the drawings in general, it will be understood that the illustrations are for the purpose of describing embodiments of the disclosure and are not intended to limit the disclosure or any invention thereto. As best seen in FIGS. 1 and 2, a medical protection and comfort brassiere 10 is shown embodied according to the present disclosure. The brassiere 10 includes helical regions 60*a*, 60*b*, a pair of superior spacers 30*a*, 30*b* having at least one impact absorbent pad 14 integrally aligned in the brassiere 10 to provide impact and abrasion protection, while at the same time alleviating aesthetic concerns. For instance, in a donned position, a first impact absorbent pad 14 typically aligns with the shoulder/chest cavity to protect the area upon which the medical procedure was performed, while a second pad 14 provides a symmetrical, aesthetically-pleasing appearance, particularly when worn underneath clothing.

The term medical devices used herein may refer to any device and/or system protruding from a patient's body, including, but not limed to, any implanted device, for instance any Class III medical device as classified by the US Food and Drug Administration, which are incorporated herein by reference.

The medical brassiere 10 is generally configured to be worn under clothing of a patient with any variety of medical device or implant. In any of the embodiments and examples shown and described herein, the term patient typically refers to a female patient and the medical brassiere 10 may be donned under any traditional clothing, for illustrative purposes only, but not limited thereto, tops, shirts, jackets, jerseys, blouses, dresses, and the like. However, in yet further embodiments and examples, the brassiere may be donned by a male patient.

Embodiments of the brassiere may include a variety of configurations and arrangements as generally shown and described herein. For instance, FIGS. 1 and 2 show one embodiment of a brassiere having a first helical region 60 and a second helical region 62. The first helical region 60 and a second helical region 62 may be aligned together in a variety of configurations, including being joined at a front 12 and a rear 84 of the brassiere 10. As shown in FIG. 1, the brassiere 10 may be generally donned over a patient's breast, chest, torso, or the like, and includes at least one impact absorbent pad 14 to provide comfort and a cosmetic body-conforming appearance. Typically, the brassiere 10 provides comfort to an area adjacent an implanted device by generally decreasing the contact and friction caused by the movement of the device.

The brassiere 10 may include a reinforcing seam 62 positioned along peripheral portions 64 of the helical regions 60, 60*a*, respectively. As show in FIG. 1, the reinforcing seam 62 along the peripheral portions 64 of said first helical region 60 and second helical region 60*a* define a pair of opposing cups 80*a*, 80*b* as understood by those skilled in the art. Any of the cups 80*a*, 80*b* shown and described herein may include a breast-shape conformer 72, for instance to conform in appearance to a breast. The breast-shape conformer 72 may be sized and shaped to replicate a full or partially removed breast, for instance to mate with a patient's breast anatomy following a mastectomy or the like. In particular examples, the breast-shape conformer 72 may be a padding, an implant, a plurality of fabric layers, a combinations thereof, and the like.

FIG. 1 shows the brassiere includes tapered shoulder supports 40, for instance inwardly tapered straps, on opposing sides of a neck opening 34. As shown in FIG. 1, the brassiere may include opposing tapered arm openings 32 to facilitate freedom of movement and minimize abrasion between contact of the brassiere and skin. The brassiere may include a breathable midsection 16, and in some cases the breathable midsection 16 may be a mesh or similar breathable section. The brassiere may also include a lower stretch band 42 to generally compress and maintain any of the elements shown and described against the patient in a donned positioned as understood by those skilled in the art having the benefit of this disclosure.

As further shown in FIG. 1, the first and second superior spacers 30*a*, 30*b* may include a pair of impact absorbent pads 14 may be spaced apart from one another to align at, or above, the left and right pectoral region when the brassiere is worn. The impact absorbent pads 14 generally masks the outline of any implanted device described herein. For instance, the impact absorbent pads 14 may conceal cardiac leads, wiring, tubing, protrusions, and the like.

The pair of impact absorbent pads 14 may include arched lower ends 18 to generally conform to the natural contour of a breast region, or similar anatomical features, of a patient. In some examples, the arched lower ends 18 are spaced below a housing seam 26 in the body fabric 12. Similarly, the impact absorbent pads 14 may have a generally convex contour to provide an appearance of symmetry to the patient's asymmetrical chest surface, for instance as created by an implanted medical device or the like.

In some embodiments, the impact absorbent pad 14 includes an antimicrobial, antiseptic, and the like protection. For instance, the impact absorbent pad 14 may include a metal embedded or lined in any of the impact absorbent pads 14 shown and described herein. In one example, the impact absorbent pads 14 have an embedded silver infused antimicrobial. For instance, the silver may be embedded as a finisher to coat impact absorbent pad fibers. In alternative examples, any portions or elements of the body fabrics 12 and/or impact absorbent pads 14 may include metallic, including but not limited to silver, components, linings, and the like.

FIG. 1 shows one example of a stretchable periphery assembly between the pads 14 and portions of the brassiere. Typically, the stretchable periphery assembly is stretchable about multiple axes, for instance about an X-axis as the brassiere is shown positioned vertically in the figure and about a substantially perpendicular Y-axis. Other arrangements include additional oriented dual axes stretching. In some examples, a stretchable distal periphery 20 may be positioned between one pad 14 and the arm opening 32. Further, a stretchable proximate periphery 24 may be positioned between one pad 14 and the V-neck portion 36. The pads 14 and arm openings 32, and in some examples the stretchable distal periphery, may meet and be secured together at terminating seam 46 or the like. Those of ordinary skill in the art having the benefit of this disclosure will recognize modified arrangements and orientations of the elements, including but not limited to padding placement and securing means, shown and described herein.

The brassiere 10 may include lateral spacers having similar attributes of the superior spacers shown and descried herein. For instance, as illustrated in FIG. 1, a left lateral spacer 90*a* may be positioned laterally adjacent to the first helical region 60. Similarly, a right lateral spacer 90*b* may be positioned laterally adjacent to the second helical region 60*a*. The lateral spacer 90*a* and/or right lateral spacer 90*b* may include any of the impact absorbent pads 14 shown and described herein. In one example, the impact absorbent pads 14 in a lateral spacer includes an arched side 18 having a concave contour. The lateral spacer may thereby mate with the helical regions to define an integral appearance for a pleasing and confident aesthetic appearance.

The impact absorbent pads 14 shown and described herein may comprise a variety of materials and geometric shapes and arrangements. In one example, the impact absorbent pads 14 include polyester and spandex. For instance, the impact absorbent pads 14 may include about sixty percent to about ninety five percent polyester, including about eighty-eight percent polyester. Further, the impact absorbent pads 14 may include about five to about forty percent spandex, including about twelve percent spandex. In particular examples, the yarn content of the impact absorbent pads 14 may include eighty-eight percent 70/72 textured polyester. Similarly, in particular examples, the yarn content of the impact absorbent pads 14 may include twelve percent 40 den spandex.

In one example, the impact absorbent pads 14 may be in the range of about forty to about fifty five inches in width. Applicant has discovered surprising uniform alignment advantages of an impact absorbent pads 14 with about a forty-eight inch in width. Similarly, the impact absorbent pads 14 may be in the range of about forty to about fifty five inches in height. Applicant has discovered surprising uniform alignment advantages of an impact absorbent pads 14 with about a forty-nine inch height.

Embodiments of the impact absorbent pad 14 include a variety of weights to provide the protection and to absorb compression forces shown and described herein. For instance, in some examples the weight of the impact absorbent pad 14 may be about seventeen ounces per square yard.

Embodiments of the impact absorbent pad 14 include a variety of yields to provide the protection and to absorb compression forces shown and described herein. For instance, in some examples the weight of the impact absorbent pad 14 may be about 0.70 fin yards/gr pound.

Embodiments of the brassiere include at least one impact absorbent pad 14 in the superior spacers or the lateral spacers, as shown and described herein; however, other examples include multiple, including two or more, stacked impact absorbent pads 14, for instance positioned on top of one another to increase protection and absorb forces from outside sources. The impact absorbent pad 14 may be a variety of thickness to provide the protective and compression forces shown and described herein and/or match the contours, i.e. chest and/or other anatomical features, of the patient. For instance, in some examples the impact absorbent pad 14 may be about 0.130 to about 0.132 inches thick. Typically, the impact absorbent pad 14 is uniform thickness to provide the symmetrical appearance described herein.

Embodiments of the impact absorbent pad 14 include a variety of dual-axis elongation, i.e. stretching about a y-axis and an x-axis, attributes to provide the uniform and compression forces shown and described herein. For instance, in some examples the impact absorbent pad 14 has a length elongation between about 115% to about 165%, including about 124.29% length elongation. Similarly, in some examples the impact absorbent pad 14 has a width elongation between about 50% to about 80%, including about 79.96% width elongation.

Embodiments of the support body 12 comprise a variety of materials and features to match the patient's medical needs and aesthetic interests, while providing the housing and support for any of the impact absorbent pads shown and described herein. In one example, the support body 12 comprises a cotton and Lycra blend, for instance an eighty one percent cotton and nineteen percent Lycra blend. In this example, the support body may have a width of about 63-65 inches, a weight of about 6.7 oz./sq. yard, a linear weight of about 12 oz/lin yard, about 93 courses and 49 wales, a length shrinkage of about five percent AATCC 135, a width shrinkage of about five percent AATCC 135, a length stretch of about 100 percent hand stretch, and a width stretch of about 121 percent hand stretch.

In another example, the support body 12 comprises a modal and Lycra blend, for instance an eighty seven percent modal and thirteen percent Lycra blend. In this example, the support body may have a width of about 58-60 inches, a weight of about 8.8 oz/sq. yard, a linear weight of about 14.75 oz/lin yard, about 58 courses and 43 wales, a length shrinkage of about five percent AATCC 135, a width shrinkage of about seven percent AATCC 135, a length stretch of about 125 percent hand stretch, a width stretch of about 140 percent hand stretch. Further examples include a polyester and Lycra blend.

In use, any of the brassieres 10 shown and described herein may be donned on a post-surgical, or similar, patient to provide comfort and protection against implanted devices and the like as understood by those skill in the art having the benefit of this disclosure. For illustrative purposes, but not limited thereto, the brassiere 10 may provide uniform compression against the designated area of the patient's body having the implanted device, protrusion, or the like. Applicant has unexpectedly discovered the brassiere 10 reduces the incidence of the implanted device eroding from the body, for instance the tight-fitting assembly of the brassiere 10 against the body limits, or eliminates, traditional incidence of the implanted device eroding from the body. Further, the brassiere may reduce the movement of the implanted medical device in the body due to the compressive forces and tight-fitting arrangements shown and described herein. Further, in particular applications, the brassiere 10 may reduce the friction between an implanted cardiac lead, pacemaker, AICD and body tissue. The brassiere may reduce implanted lead insulation breakdown when connected to an implanted cardiac device, for instance by reducing abrasion forces against the opposing surface. The brassiere may reduce the incidence for pocket revision that is generally associated with implanted medical cardiac device pocket erosion. In addition, the brassiere 10 has surprisingly been found to reduce the pain experienced by patients in implanted cardiac devices. The brassiere 10 further reduces the impact exerted to implanted medical devices by seatbelts and similar outside forces. The brassiere 10 additionally reduces the discomfort experienced by patients when exercising or performing ordinary daily chores. As shown and described herein, the brassiere improves the asymmetrical body appearance created by an implanted medical device, for instance the brassiere may mask the implanted device and improves the patient's torso appearance. Additionally, the antimicrobial feature of the brassiere 10 may reduce skin infection, and the like, at an incision location as recognized by those skilled in the art having the benefit of this disclosure.

The disclosure also includes a brassiere kit. The kit may comprise a body 12, e.g. any of the body elements and examples previously shown or described. Further, the kit may comprise an impact absorbing pad 14, e.g. any of the pad elements and examples previously shown or described. The kits may be assembled to provide the features and advantages of the brassieres shown and described herein, including removable and/or reusable padding and the like.

In alternative embodiments, any of the impact absorbent pads 14 shown and described herein may be positioned at varying locations on the brassiere to alleviate and comfort the patient depending on the particular area of the body that was subject to the surgical implant or the like. For instance, the impact absorbent pads 14 may be positioned along the abdominal area, for instance patients having undergone abdominal surgery, an appendectomy, and the like; may be positioned along the lower back, for instance a patient having undergone lower back surgery or the like.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

I claim:

1. A medical brassiere to be donned by a patient with an implanted pacemaker aligned vertically above a breast of the patient, said brassiere comprising:

a. a first helical region and a second helical region joined at a front and a rear of said brassiere, each of said first and said second helical regions including a reinforcing seam positioned along peripheral portions of said first helical region and second helical region to define a pair of opposing cups;

b. a first and a second superior spacer vertically aligned above said cups, each of said spacers including a pair of opposing impact absorbent pads having an embedded silver infused antimicrobial and an arched lower end, wherein each impact absorbent pad is spaced apart from a stretchable distal periphery and aligned with an upper end of said helical region; and c. a shoulder support elongating each of said helical regions and spacers against a wearer when said brassiere is in a donned position regardless of a movement of said spacer about said implanted pacemaker, and wherein a first said pad being aligned over said implanted pacemaker in a donned position so as to cover said pacemaker and a second said pad spaced parallel with said first pad and adapted to provide an appearance of symmetry to said patient's asymmetrical chest surface.

2. The brassiere of claim 1, further including a right lateral spacer positioned laterally adjacent said first helical region, and a left lateral spacer positioned laterally adjacent said second helical region.

3. The brassiere of claim 1, wherein said impact absorbent pads comprise a substantially concave contour to mate with said helical regions to define an integral appearance in said donned position.

4. The brassiere of claim 3, wherein said brassiere masks said implanted pacemaker in said donned position.

5. The brassiere of claim 2, wherein said lateral spacers being positioned proximate an area adjacent to a subcutaneous pacemaker implant.

6. The brassiere of claim 5, wherein said implant being positioned outside of said patient's ribcage.

7. The brassiere of claim 1, wherein a pressure of said first pad in the donned position is adapted to reduce the movement of the implanted pacemaker about said patient's body.

8. The brassiere of claim 1, wherein a pressure of said first pad in the donned position is adapted to reduce a friction between said implanted pacemaker and body tissue.

9. A post-surgical brassiere comprising:

a. a first helical region and a second helical region joined at a front and a rear of said brassiere, each of said first and second helical regions including a fabric body having an upper compression zone, wherein said compression zone includes opposing silver embedded impact absorbent pads configured to be compressed over a surgical site of a patient; and b. a stretchable periphery assembly comprising a stretchable distal periphery positioned between an outer end of said fabric body and at least one of said pads, and a stretchable proximate periphery joining said first and second helical regions, and wherein a surface area of each helical region is substantially larger than a surface area of said impact absorbent pads.

10. The brassiere of claim 9, wherein said fabric body includes a breathable midsection between said opposing pads.

11. The brassiere of claim 9, wherein said fabric body includes a partially elastic material adapted to position said compression zone against said surgical site on said patient.

12. The brassiere of claim 9, further including a breast-shape conformer to conform in appearance to a breast, wherein said breast-shape conformer is chosen from a padding, an implant, a plurality of fabric layers, and combinations thereof.

13. The brassiere of claim 9, wherein said first helical region and said second helical region are releasably joined at a portion of the brassiere chosen from a front of said brassiere and a rear of said brassiere.

14. The brassiere of claim 9, wherein said stretchable periphery assembly stretches about one axis and about a perpendicular second axis.

15. The brassiere of claim 9, wherein each of said pads comprise an arched lower end.

16. The brassiere of claim 15, wherein said each of said pads comprise a substantially concave contour.

17. A medical brassiere to be donned by a female patient with an implanted medical device, said brassiere comprising:

a. a first helical region and a second helical region joined at a front and a rear of said brassiere, each of said first and said second helical regions including a reinforcing seam positioned along peripheral portions of said first helical region and second helical region to define a pair of opposing cups;

b. a first and a second superior spacer vertically aligned above said cups, each of said spacers including a pair of opposing impact absorbent pads having an embedded silver infused antimicrobial and a concave lower end, wherein each impact absorbent pad is spaced apart from a stretchable distal periphery and aligned with an upper end of said helical region;

c. a right lateral spacer positioned laterally adjacent said first helical region and having an impact absorbent pad, and a left lateral spacer positioned laterally adjacent said second helical region and having an impact absorbent pad; and d. a shoulder support and lower stretch band elongating each of said helical regions and first and second spacers against a wearer when said brassiere is in an donned position regardless of a movement of said spacer about said implanted device.

18. The brassiere of claim 17, wherein a first said pad being aligned over said implanted medical device in a donned position so as to cover said implanted medical device and a second said pad being parallel to said first pad and adapted to provide an appearance of symmetry to a patient's asymmetrical chest surface.

* * * * *